US005896819A

United States Patent [19]

Turila et al.

[11] Patent Number: 5,896,819

[45] Date of Patent: Apr. 27, 1999

[54] STACKABLE METAL STRUCTURED PALLET

[75] Inventors: Samuli Turila, Vaskio; Sakari Turila, Halikko, both of Finland

[73] Assignee: Westem Oy, Vaskio, Finland

[21] Appl. No.: 08/836,904

[22] PCT Filed: Dec. 8, 1995

[86] PCT No.: PCT/FI95/00672

§ 371 Date: May 21, 1997

§ 102(e) Date: May 21, 1997

[87] PCT Pub. No.: WO96/17782

PCT Pub. Date: Jun. 13, 1996

[30] Foreign Application Priority Data

Aug. 12, 1994 [FI] Finland ..... 945756

[51] Int. Cl.[6] ..... B65D 19/00

[52] U.S. Cl. ..... 108/57.3; 108/57.32

[58] Field of Search ..... 108/51.11, 57.3, 108/57.32, 51.3

[56] References Cited

U.S. PATENT DOCUMENTS

| | | | |
|---|---|---|---|
| 1,321,812 | 11/1919 | Drumm | 108/57.32 X |
| 1,508,898 | 9/1924 | Smith | 108/57.3 |
| 1,797,874 | 3/1931 | Millray | 108/57.3 |
| 1,922,560 | 8/1933 | Sullivan | 108/57.32 X |
| 2,099,051 | 11/1937 | Clark et al. | 108/57.3 |
| 2,256,750 | 9/1941 | Riemenschneider | 108/57.3 |
| 3,776,146 | 12/1973 | Morrison | 108/57.3 |
| 4,759,295 | 7/1988 | Nilsen et al. | 108/51.3 |

*Primary Examiner*—Jose V. Chen
*Attorney, Agent, or Firm*—Marshall & Melhorn

[57] ABSTRACT

The present disclosure relates to a stackable metal-structured pallet. The pallet is made of a single piece blank separated from a sheet web, the blank including at least two lengthwise profilings which provide footings for the pallet. The ends of the lengthwise profilings include a respective edge cutout including skirt portions which extend parallel to an edge and are located opposite to each other. The skirt portions have tip portions, the tip portions are superimposed upon each other and connected to each other, this way making the edge portions continuous.

The disclosure relates also to a method for fabricating a metal-structured pallet. The method comprises the steps of: a) feeding a sheet web to a punching station for punching the sheet web to provide it with appropriate edge cutouts which include skirt portions extending parallel to a respective sheet edge and located opposite to each other, b) feeding the sheet web to a roll milling station for pressing the sheet web to provide it with lengthwise profilings extending between the respective oppositely located edge cutouts without substantially stretching the sheet material, whereby the skirt portions having tip portions, the tip portions shift toward each other to an at least partially superimposed position, and c) cutting the sheet web to a blank sheet and connecting the tip portions to each other. An optional final step may be double folding the edge portions.

14 Claims, 1 Drawing Sheet

STACKABLE METAL STRUCTURED PALLET

The present invention relates to a stackable metal-structured pallet and a method for fabricating the same. In its main dimensions the pallet corresponds to prior known standard-size pallets and is intended for similar service.

The prior known pallets used in handling of materials and goods are generally wood-structured. There are also special purpose pallets made of metal and artificial material such pallets have been described e.g. in publications U.S. Pat. No. 2,447,542, FI 26164 and WO 92/14654, SE 413, 303, SE 408,046 and FI 69433. Methods used in metal-based pallet fabrication have been disclosed e.g. in the Patent publication SE 446,258.

Dimensionally, the pallets are usually so-called Fin-pallets with the main dimensions of 1000×1200 mm or so-called Euro-pallets with the size of 800×1200 mm. The height of such pallets is about 100–150 mm.

Major drawbacks in traditional wooden pallets include the facts that such pallets are easily damaged, require a lot of space when stored in unloaded condition, create a fire hazard and have a relatively high production price.

Certain prior known pallet constructions based on artificial materials and metals enable the elimination of the above drawbacks, excluding the manufacturing price. The prior known metal pallets are usually structurally complicated and expensive and this has prevented their widespread use.

A pallet manufacturing method of the invention and pallets produced thereby provide a substantial improvement for the above drawbacks. In order to achieve this, a pallet of the invention is characterized by what is set forth in the characterizing clause of claim 1.

The most important benefit of the invention is probably the fact that it enables the fabrication of a metal-frame pallet, which is only based on working a blank sheet and does not require separate connecting profiles. In various working stages the blank sheet is shaped and designed into a user friendly and safe pallet. The fabrication is based on a simple method of low production costs, which can be preferably automated. One major benefit of the invention is that the metal sheet is shaped without substantially stretching it, which facilitates the use of previously coated, e.g. zinc- or plastic-coated steel sheet without a hazard of damaging the coating.

The features characterizing a method of the invention are set forth in the characterizing clause of claim 5.

The invention will now be described in detail with reference made to the accompanying drawing.

Figure 1:
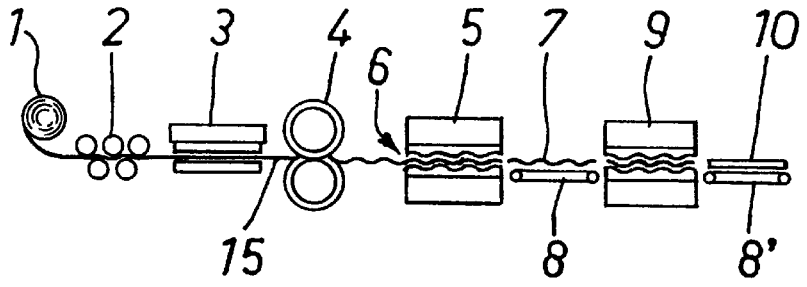
FIG. 1 shows a fabrication method of the invention in principle.

Referring to FIG. 1, the metal stock is supplied from a roll of sheet metal 1 and carried through a straightening roller 2 to a punching station 3 for punching a sheet web 15 into an appropriate shape. This shape is depicted more closely in FIG. 2. Downstream of the punching station 3 the sheet web 15 is carried to a roll milling station 4 for pressing a lengthwise profiling 16 on the sheet web 15. This profiling also provides a proper basic position for edges R, R'. Thereafter, the sheet web 15 milled as described above is carried to a shaping station 5 for pressing the sheet web 15 to its precise shape by means of conventional counterblocks followed by cutting the sheet web 15 into pallet blanks 7 by means of a cutter 6.

When the pallet blank 7 is in the above supported position, its skirt portions 13 and 14 are riveted (e.g. by using TOX riveting) to each other and the first stage of shaping the edges R, R' of said pallet blank 7, or bending an edge portion r, r' about 90 degrees downwards, is effected. A conveyor 8 carried the riveted and nearly finished pallet blanks 7 to a finishing station 9 for carrying out additional double-folding of the edge portions r, r' and on the pallet blanks 7 are pressed the final surface profilings required by proper bracing. A conveyor 8' is used for carrying finished pallets 10 to a desired depot, e.g. a warehouse.

The structure and functions of the sheet roll 1, straightening roller 2 and punching station 3 are known as such. The roll milling station 4 is based on two roll rotating opposite each other, provided with appropriately shaped surface for giving a desired profiling to the sheet web 15 passing therethrough. The roll milling station 4 can also be used for drawing the sheet web 15.

The shaping station 5 is based on a press fitted with appropriate pressing tools and provided with riveting means in cooperation therewith as well as on the cutter 6. In principle, the shaping station 9 is structurally similar to the shaping station 5, yet without the cutter 6.

The stations 3, 4, 5 and 9 can be provided with implements of various designs and dimensions for fabricating various types of pallets 10. The production line 1, 2, 3, 4, 5, 8, 8' and 9 has its various working stations synchronized with each other for a smooth and troublefree operation.

Figure 2:
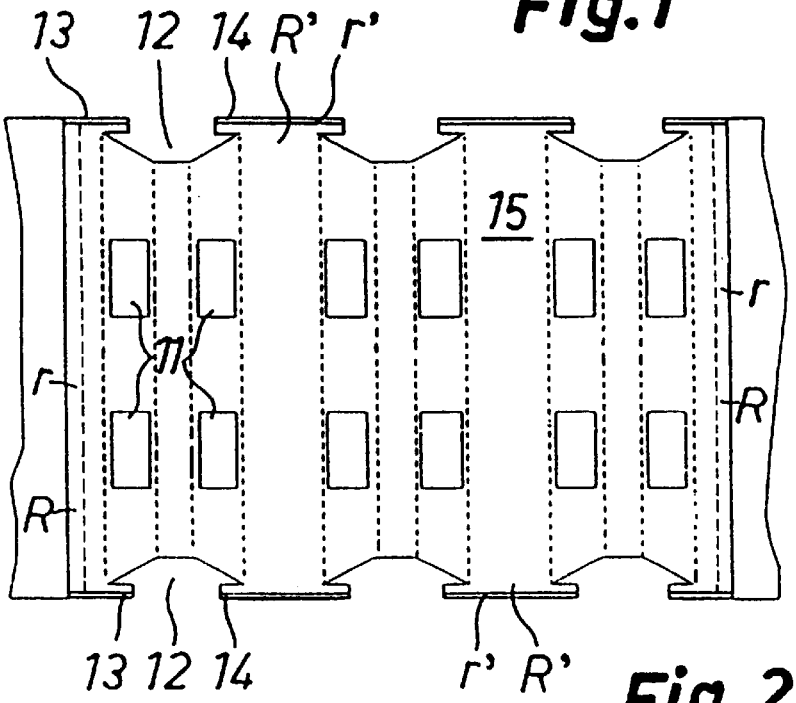
FIG. 2 shows a blank sheet for a pallet of the invention.

FIG. 2 depicts a sheet web 15 including a cutout worked thereon in the punching station 3. The cutout 12 formed between skirt portions 13 and 14 serves to provide inclined or oblique ends for a pallet 10. This enables easy and self-guided stacking or nesting of the pallets 10 on top of each other. Empty pallets fit within each other and a single additional pallet only increases the height of a stack by the thickness of completely shaped edges R, R', which in the present case is about 4 times the thickness of a blank sheet. In addition to openings shaped like the cutouts 12, the sheet web 15 is provided with punched openings 11 for forklift pockets. These openings 11 make the pallet 10 into a four-way pallet that can be lifted both by the ends and by the sides.

The vertical dashed lines represent profiling lines to be made in the roll milling station 4 as described above. The vertical and horizontal dotted lines represent profiling lines to be made in the shaping station 5 and finishing station 9.

Figure 3:
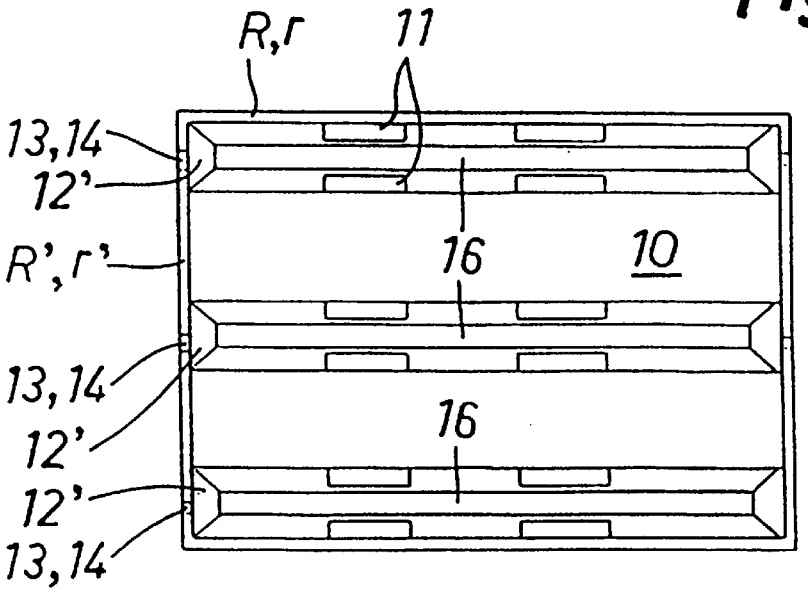
FIG. 3 shows a pallet of the invention in a plan view.

FIG. 3 depicts a finished metal-structured pallet 10, which is fabricated according to the invention and provided with inclined ends formed by the cutout 12 and including openings 12' and whose edges R, R' are double-folded for providing a smooth and rounded outer rim.

Although not shown in the figures, the pallet 10 may include a plurality of longitudinal and horizontal per se known surface profilings for reinforcing the sheet surfaces. These profilings are produced in stations 5 and 9. Said profiling, which is not of any great height, can also be made in the punching station 3 or as a part of the function of the roll milling station 4.

Referring to the above, there is produced a metal-structured pallet 10 whose supply stock comprises a flat sheet. All profiles included in the pallet 10 are produced by milling the supply blank without using any attachments.

In regard to conventional standardized pallets, the appropriate sheet thickness is 1,5–2 mm. As for smaller disposable pallets, the relevant material thicknesses can be as low as below 1 mm.

The bracing edges R, R' in pallets of the invention intended for carrying heavier goods can be reinforced with extra 180-degree folds. Thus, this must also be considered in the selection and dimensioning of a sheet web 15. According to the invention, the edge profile, extending continuously in the finished condition and included in one side edge R' of the pallet 10, is produced by punching the blank sheet 15 to form therein cutouts of the appropriate size and shape 12, said cutouts including skirt portions 13, 14 which are stackable on top of each other in subsequent milling but discontinuous at the blank stage and which, during the course of milling, are secured to each other by riveting, welding or some other joining technique. At the moment, riveting is considered the most suitable technique for use in connection with coated steel plate material. Welding is good e.g. for joining aluminium or uncoated steel. At this milling step, the pallet's edges are shifted towards each other to a superimposed position and connected to each other for making the edge portions continuous.

Another benefit gained by a pallet of the invention is that, due to a small sheet thickness, the overall height of a pallet will be substantially lower than that of e.g. wooden pallets or prior art metal pallets, the latter including attachments and intensive profilings. In wooden pallets, for example, both the bottom and the top surfaces generally consist of 20 mm boards and, thus, the overall height of a pallet is nearly 40 mm more than that of a pallet of the invention. The edge profiles designed as described above are used for bracing the pallet 10 to its form.

A method of the invention is economical in terms of its production costs as it enables the use of a precoated steel sheet. This is based on the use of rolls in profiling, the rolls drawing more material to the roll milling station during the profiling process and, thus, the material does not substantially stretch and the coating remains intact and adhered to the material. The method is also applicable to other metal materials, such as aluminium, whereby the extra thickness required by the material is taken into account by adjusting the roll nip accordingly.

The invention has been described above by referring to just a few exemplary embodiments thereof. However, by no means should this limit the invention to these examples only but, instead, a wide variety of modifications are conceivable within the scope of an inventional concept defined in the annexed claims.

We claim:

1. A stackable metal-structured pallet made of a single piece blank, said pallet comprising at least two lengthwise profilings which provide footings for the pallet, and whose ends include a respective edge cutout, wherein said cutouts leave skirt portions which extend in parallel to an edge of the blank, said skirt portions having tip portions superimposed upon and connected to each other, this way making the edge portions continuous.

2. A pallet as claimed in claim 1, wherein the profilings include openings which serve as lifting slots for inserting the forks of a lifting apparatus laterally therein, whereas the edge cutouts serve as lifting slots for inserting the forks of a lifting apparatus longitudinally therein, whereby the pallet serves as a four-way pallet.

3. A pallet as claimed in claim 2, wherein the blank material is one selected from the group comprising steel, aluminum and coated steel.

4. A pallet as claimed in claim 2, wherein the tip portions of said skirt portions are connected to each other by riveting.

5. A pallet as claimed in claim 2, wherein the tip portions of said skirt portions are connected to each other by welding.

6. A pallet as claimed in claim 1, wherein the blank material is one selected from the group comprising steel, aluminum and coated steel.

7. A pallet as claimed in claim 1, wherein the tip portions of said skirt portions are connected to each other by riveting.

8. A pallet as claimed in claim 1, wherein the tip portions of said skirt portions are connected to each other by welding.

9. A method for fabricating a metal-structured pallet, comprising the steps of:

a) feeding a sheet web to a punching station for punching the sheet web to provide it with appropriate edge cutouts which leave skirt portions that extend in parallel to a respective sheet edge, said skirt portions having tip portions located opposite to each other;

b) feeding the sheet web to a roll milling station for pressing the sheet web to provide it with lengthwise profilings extending between the respective oppositely located edge cutouts without substantially stretching the sheet material, whereby said tip portions shift towards each other to an at least partially superimposed position; and c) cutting the sheet web in order to obtain an individual blank sheet as well as connecting the tip portions to each other, either before or after cutting the sheet web, in order to form a pallet.

10. A method as claimed in claim 9, further including a final step of double-folding the edge portions.

11. A method as claimed in claim 10, wherein the tip portions are connected to each other by one of the methods selected from the group comprising of riveting and welding.

12. A method as claimed in claim 10, wherein the sheet web material in the method is selected from the group comprising steel, aluminum and coated steel.

13. A method as claimed in claim 9, wherein the tip portions are connected to each other by one of the methods selected from the group comprising of riveting and welding.

14. A method as claimed in claim 9 wherein the sheet web material in the method is selected from the group comprising steel, aluminum and coated steel.

* * * * *